United States Patent [19]

Kingsley

[11] 4,095,340

[45] Jun. 20, 1978

[54] APPARATUS FOR TRIMMING OVERLAPPING EDGES

[76] Inventor: Ronald Kingsley, Fyler Rd., Chittenango, N.Y. 13037

[21] Appl. No.: 757,770

[22] Filed: Jan. 7, 1977

[51] Int. Cl.[2] ..... B26B 27/00; B25F 1/04

[52] U.S. Cl. ..... 30/287; 30/294; 7/105; 7/163

[58] Field of Search ..... 30/287, 294, 299; 7/14.1 R, 1 M, 13; 33/32 R, 32 B, 32 C, 334

[56] References Cited

U.S. PATENT DOCUMENTS

| | | | |
|---|---|---|---|
| 812,740 | 2/1906 | Harris et al. | 7/14.1 R |
| 1,517,986 | 12/1924 | Hayward | 7/13 |
| 1,732,564 | 10/1929 | Mayer | 30/294 X |
| 2,013,893 | 9/1935 | Matthews | 30/294 X |
| 2,758,650 | 8/1956 | Lowens | 30/294 |

*Primary Examiner*—James L. Jones, Jr.
*Assistant Examiner*—Nicholas P. Godici
*Attorney, Agent, or Firm*—James Magee, Jr.

[57] ABSTRACT

The specification discloses a device for trimming overlapping edges of material to form a butt-seam comprising a support body, means for vertical alignment, and a double bladed cutting tool for making successive cuts along the same path or track.

3 Claims, 4 Drawing Figures

APPARATUS FOR TRIMMING OVERLAPPING EDGES

This invention is directed toward a device for trimming adjacent overlapping edges of a thin guage material such as wall covering in order to provide an even and matching butt-seam. The apparatus of this invention is capable of providing a perfectly matched vertical pair of abutting edges.

In applying covering material such as paper, plastic or fabric by means of a glue or paste the adjacent strips or runs are frequently overlapped some small amount such as one-quarter to one-half inch. The butt-seam is then made by cutting down the approximate center of the overlapped portions and removing the cut-off edges of both upper and lower layers. The newly created edges then should fit together to form an even and matched seam. In practice, however, this cutting operation is difficult to execute accurately due to the tearable nature of the workpiece, e.g., the paper, vinyl or plastic. The water-base paste which is used to secure the covering to the wall softens the fibers and increases the danger of tearing. The paste also fouls the cutting edge causing it to tear the paper rather than cut it. This is particularly troublesome when one attempts to cut through both layers of paper in a single stroke. If each layer is cut separately it is almost impossible to cut along the same track to provide the matching seams.

The principal object of this invention is to provide an apparatus capable of precise and efficient cutting of overlapping layers of material in order to produce a matching butt-seam.

Another object of the invention is to provide a device for facilitating a rapid, accurate cutting of overlapping edges of a wall paper, wall plastic or wall fabric covering material so that the edges of the cut portion will butt against each other in a uniform and perfect manner.

A further object of the invention is to provide means for accurately cutting a vertical edge through overlapping layers of paper, plastic or fabric materials. A further object of the invention is to provide a device for rapid and accurate cutting of wall paper without tearing and the resulting production of matching seams.

A further object of the invention is to provide an apparatus for the successive performance of sequential cutting operations along the same path.

BRIEF SUMMARY OF THE INVENTION

These and other objects of the invention are achieved by a device comprising a base for positioning and vertically aligning the track or path of a pair of cutting blades or tools arranged so that the blades sequentially cut along the same path but in opposite directions, and means for operatively attaching the blades to the base. In particular embodiments the base can be provided with various track means for mounting the blades in sliding engagement with the base.

The contemplated device is a cutting tool comprising a base of substantial length for stabilizing the apparatus against the work surface, a track associated with the base, a cutting tool having at least two blades slidably mounted on said track for reciprocatory movement along the track, means for operatively engaging one blade or another, as desired, and means for vertically aligning the base and therefore the track. Optionally, the entire assembly may be fitted with a handle or other holding means in order to facilitate placement and retention against the work piece.

The instant invention will be more easily understood when considered with reference to the description and the drawings in which.

DESCRIPTION OF THE EMBODIMENT

Figure 1:
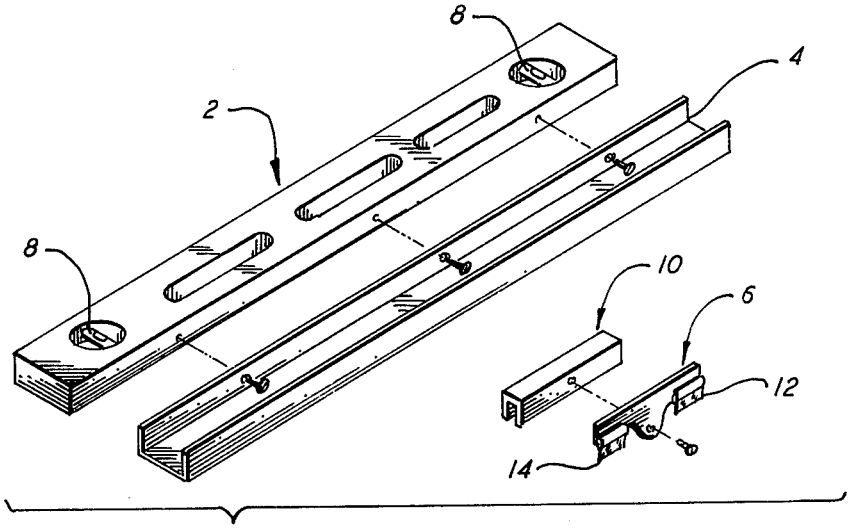
FIG. 1 is a perspective view, in exploded form, showing the various elements of an embodiment of the invention and their relationship to each other.

Referring now to FIG. 1 there is shown a carpenter's level having a geometric configuration suitable for use as the base 2, and having a pair of bubble or spirit levels 8, carried thereon. A channel shaped member 4, is shown in position for attachment to the base. The slide member 10, is shown as a channel shaped structure to which the knife holder 6, is adapted for attachment. The base 2, can be in the form of any suitable geometric shape having straight edges such as a rectangular block. The track or cutter-guide 4, can be conveniently constructed in the form of a channel shaped member of a length corresponding to the length of the base. The track can be detachably mounted on the base by means of screws or various types of clips. The track can also be manufactured as an integral portion of the base. The slide member 10, is adapted to travel back and forth along or within the track. As shown in FIG. 1, the slide member 10, is a channel shaped piece which mates with the track in a sliding arrangement. It is apparent that the slide member could also be designed in other ways to provide a smooth, reciprocal path or track to guide the cutting edges.

Figure 2:
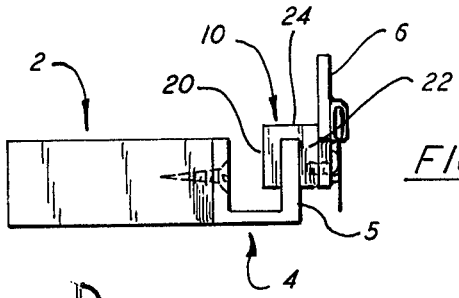
FIG. 2 is an elevational view, from one end of the apparatus, showing one embodiment of track and mounting means attached to the base with the cutter blades in place.

As shown in FIG. 2 the depending walls 20 and 22 of the slide member 10, fit closely against the upright wall 5, of the track member 10, while top wall 24, of the slide member rests on and is supported by the top edge of wall 5. This arrangement provides a wobble-free reciprocatory path for the slide and its associated cutting edges.

Figure 3:
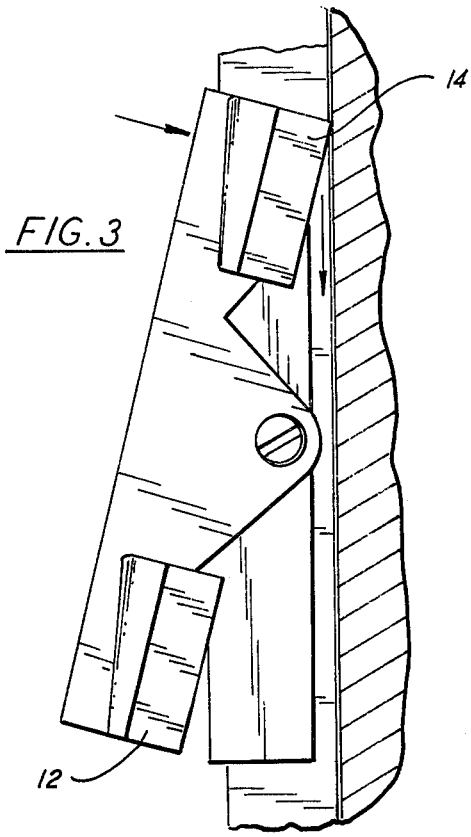
FIGS. 3 and 4 show the cutter in alternate positions for knife engagement with the work piece.
Figure 4:
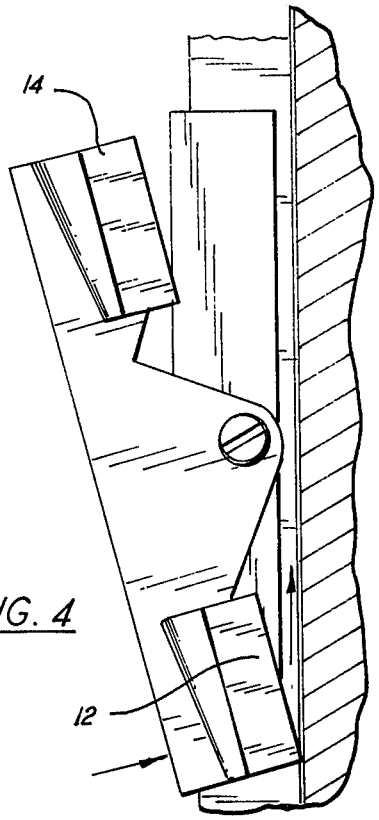

Referring again to FIG. 1 the knife holder 6, is designed to be pivotaly mounted on the slide member 10, e.g., by means of a shaft or screw, as shown. Other suitable mounting means can be employed, e.g, cotter pins, nuts and bolts, and the like. The knife holder 6, is provided with a pair of in-line cutting tools or blades, shown at 12 and 14. The blades are positioned, one at each end of the knife holder, for oppositely directional cutting. The blades are mounted on the knife holder in such a way that the cutting edges contact the work surface in a position and at an angle to provide optimum cutting. If flat blades such as razor blades are used they should be biased as shown in FIGS. 3 and 4. Similar cutting efficiency can be achieved, however, by the use of suitably engineered and shaped cutting edges. It is important that the cutting tools be mounted on the holder in such a way that they each cut in the same path or line on reciprocal strokes or passes of the slide member along the track. The pivotal action of the knife holder and successive cutting engagement of the knives is shown in FIGS. 3 and 4 in which FIG. 3 represents a downward stroke of the slide member and FIG. 4 an upward stroke of the slide member thus permitting individual cutting of overlapping layers. The cut strip usually falls free by its own weight or it can be easily pulled free. After making the first or downward cut with the first blade engaged, the knife holder is pivoted to engage the other blade with the work piece on the upward stroke while following the same track. This provides a matching cut in the lower layer of wall covering and a resulting matching butt-seam.

In operation, after adjacent strips or runs of wall paper have been pasted to the wall with the adjacent edges overlapping a suitable distance, the wall paper trimming device is positioned against the wall with the blade approximately in the center of the overlapping portion. The overall device is then vertically aligned by means of the bubble level carried in the base of the apparatus. The slide holder is positioned at the top of the base and the knife holder is pivoted to engage the blade which is adapted for cutting a downward stroke. Pressure is applied to the blade in order to cut into the top layer of wall paper. Holding the apparatus steady in order to maintain vertical alignment, the slide member is then drawn downwardly along the track with the blade engaging and cutting the wall paper throughout the entire stroke. When the slide member and knife holder reach the bottom of the stroke, the knife holder is pivoted to raise the blade from the work surface. The cut strip of wall paper can then be removed and trimmed at the end of the cut. Without moving the wall paper trimming device, the blade holder is pivoted in the opposite direction to engage the other knife which cuts into the cottom layer of wall paper on the upward stroke. The slide member and knife holder are then moved upwardly along the track to the point of beginning, at which point both layers of wall paper have been cut through. The apparatus can then be repositioned and the next section corresponding in length to the device is ready for trimming. When the entire length of wall paper has been trimmed the edges are pressed together and secured to the wall in a perfectly matching butt-seam.

What is claimed:

1. A wall paper trimmer comprising
(a) a rectangular base having flat top and bottom and parallel sides,
(b) a spirit level mounted on said base,
(c) a track secured to one of the long sides of said base, said track being of trough shaped configuration of rectangular cross section having a bottom and upwardly extending sides,
(d) a slide member in sliding engagement with said track,
(e) a knife holder pivotally mounted on said slide member by a centrally located pivot shaft,
(f) a pair of oppositely positioned linerally aligned cutting blades mounted on said knife holder.

2. The device of claim 1 wherein said track is attached to said base by one of its upwardly extending sides, the remaining side being free to engage said slide member.

3. The device of claim 1 wherein said slide member consists of a trough of rectangular cross section, a top, and a pair of downwardly extending sides adapted to engage and bear upon the non attached upwardly extending side of said track for movement along the free side of said track.

* * * * *